US007178702B2

(12) United States Patent
Maas et al.

(10) Patent No.: US 7,178,702 B2
(45) Date of Patent: Feb. 20, 2007

(54) DISPENSING DEVICE AND METHOD FOR FILLING THEREOF

(75) Inventors: Wilhelmus Johannes Joseph Maas, Someren (NL); Petrus Lambertus Wilhelmus Hurkmans, Someren (NL)

(73) Assignee: AFA Polytek, B.V. (NL)

( * ) Notice: Subject to any disclaimer, the term of this patent is extended or adjusted under 35 U.S.C. 154(b) by 299 days.

(21) Appl. No.: 10/432,665

(22) PCT Filed: Nov. 27, 2001

(86) PCT No.: PCT/NL01/00861

§ 371 (c)(1),
(2), (4) Date: Nov. 10, 2003

(87) PCT Pub. No.: WO02/42006

PCT Pub. Date: May 30, 2002

(65) Prior Publication Data

US 2004/0074928 A1 Apr. 22, 2004

(30) Foreign Application Priority Data

Nov. 27, 2000 (NL) ..... 1016714

(51) Int. Cl.
*B67D 5/40* (2006.01)

(52) U.S. Cl. ..... 222/383.1; 215/232; 220/302

(58) Field of Classification Search ..... 222/383.1; 215/332; 220/302
See application file for complete search history.

(56) References Cited

U.S. PATENT DOCUMENTS

| | | | | |
|---|---|---|---|---|
| 4,781,311 | A | 11/1988 | Dunning et al. | |
| 5,806,724 | A | 9/1998 | Foster | |
| 6,032,814 | A * | 3/2000 | Foster | 215/332 |

FOREIGN PATENT DOCUMENTS

| | | |
|---|---|---|
| EP | 0 208 390 A1 | 1/1987 |
| EP | 1 050 478 A2 | 11/2000 |

* cited by examiner

*Primary Examiner*—Philippe Derakshani
(74) *Attorney, Agent, or Firm*—Brooks Kushman P.C.

(57) ABSTRACT

The invention relates to a dispensing device, comprising a container and a dispensing head connected thereto, the container and head including a co-operating snap coupling means comprising a plurality of lugs arranged on one of the two parts to be connected and a plurality of recesses arranged in the other part for receiving the lugs in which at least one of the lugs is resiliently deformable and at least one other lug is relatively stiff and non-deformable. Such a dispensing device may swiftly and easily be filled and assembled. At least the lugs are advantageously made of a thermoplastic polyester, like e.g. PET. The invention further relates to a method for filling such a dispensing device with a medium to be dispensed.

13 Claims, 4 Drawing Sheets

Figure 1:
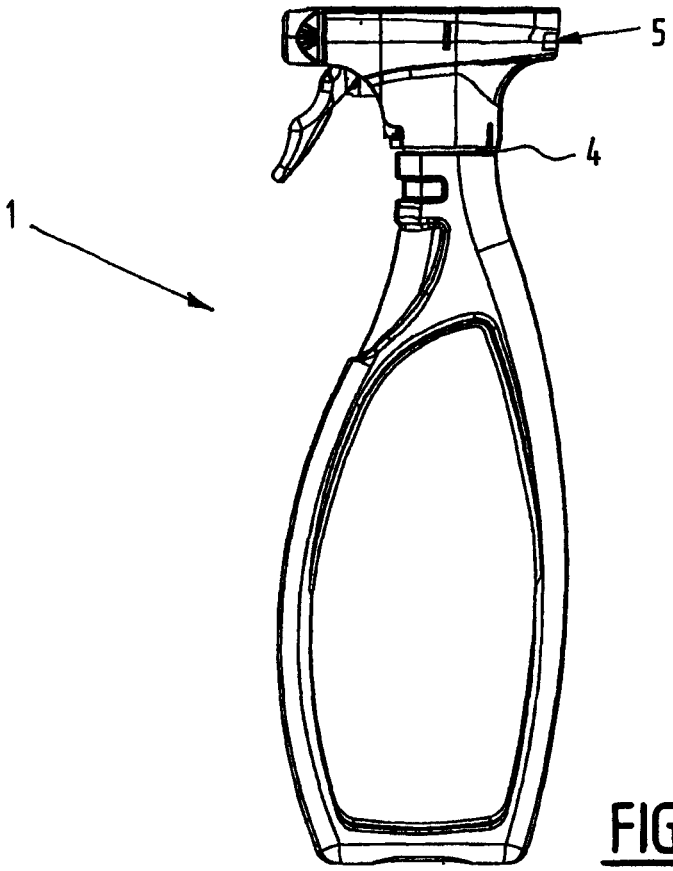

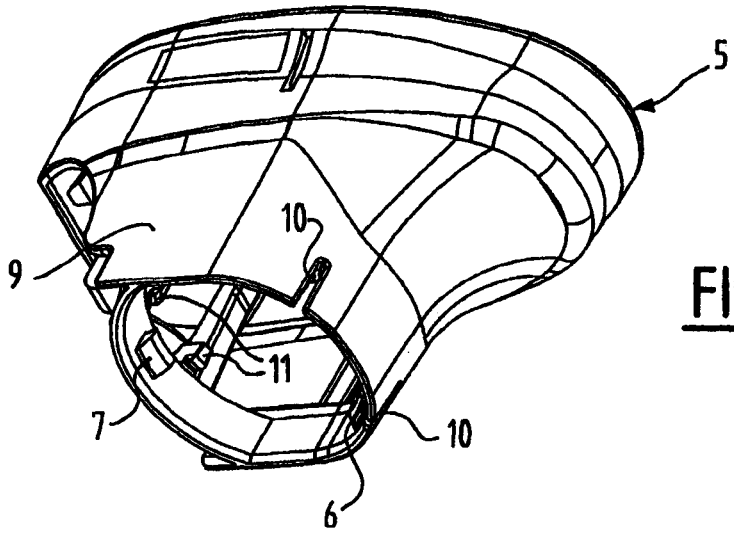
FIG. 6
FIG. 7
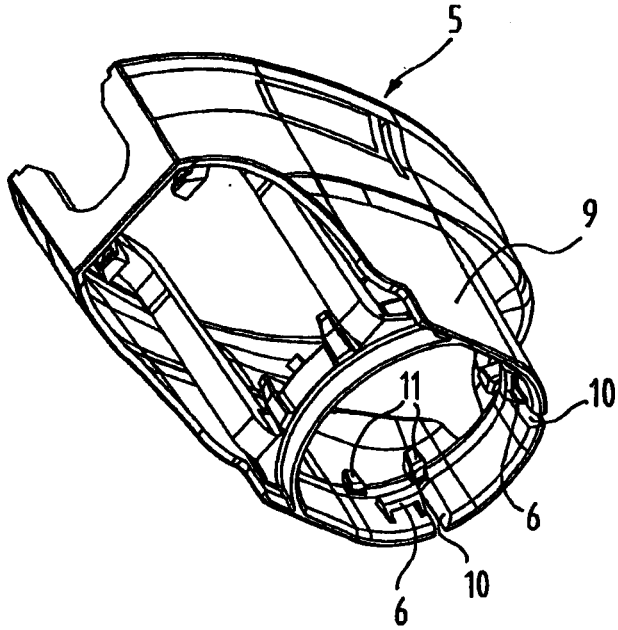
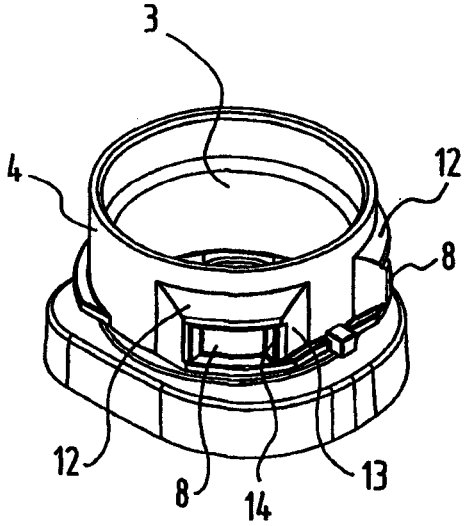
FIG. 8

DISPENSING DEVICE AND METHOD FOR FILLING THEREOF

The present invention relates to a dispensing device, comprising a container and a dispensing head connected thereto, said container and head including cooperating snap coupling means comprising a plurality of lugs arranged on one of the two parts to be connected and a plurality of recesses arranged in the other part for receiving the lugs. Such a dispensing device in the shape of a spray bottle is known from EP-A-0 208 390, and is especially used for liquid detergents.

Conventional dispensing devices consist of a bottle having a neck on which a dispensing head, normally a spray head is attached. The neck of the bottle is usually provided with threading on its external surface, while the dispensing head includes a collar fitting around the neck and having internal threading.

Such conventional dispension devices have the drawback that a screwing motion must be performed for attaching the spray head onto the bottle, so that the spray head—or at least part thereof—and the bottle must be rotated about their respective axes a number of times. This is especially disadvantageous during filling of the dispensing device, which is performed by machines in an industrial filling line. There the throughput is of great importance, and this throughput is adversely affected by the required screwing movement.

Therefore the above-identified prior art document EP-A-0 208 390 already discloses a dispensing device of which the spray head is provided with two inwardly protruding lugs and the container has two short thread portions including chamfered upper edges arranged around its neck. Near the end of each thread portion, which extends around half of the neck, a transverse rib is formed, the distance of which to the end of the thread corresponds to the width of a lug. In this way a recess is formed at the end of the thread, into which the lug may be pressed via the chamfered upper edge of the thread. As the spray head may thus be snapped onto the container, instead of having to be screwed thereon, the connection between the spray head and the container may be established more quickly and simply, by which the throughput of an automatic filling line in which this operation is performed may be increased. In order to be able to refill the container, the spray head may be released by forcing the lugs out of their recesses, after which they may be moved through the thread portions in a rotating movement, so that the dispensing head is screwed loose.

Although this known dispensing device is a major improvement over conventional devices in respect of the speed at which it may be filled, it has the drawback that it is made of polypropylene (PP). This is a relatively flexible material, which makes it difficult to attach the dispensing head sufficiently rigidly onto the container. Furthermore PP is not suited for a great many uses due to its permeability for gases and vapours.

The invention now has for its object to provide a dispensing device of the type described above, which may be made from a relatively stiff and impermeable material. In accordance with the invention this is achieved in a device of the type as defined in the pre-characterizing portion of claim 1, in that at least one of the lugs is resiliently deformable and at least one other lug is relatively stiff and non-deformable.

Due to the resiliently deformable character of one of the lugs the connection between the dispensing head and the container may be established using relatively little force, while the relatively stiff lug still guarantees an excellent sealing between the parts.

Preferably the dispensing head includes a collar directed towards the container and carrying the lugs, this collar being locally weakened in the vicinity of the or each resiliently deformable lug, by which the deformability of the lug is guaranteed, regardless of the selected material. An excellent deformability may be achieved when the collar includes at least one incision in the vicinity of the or each resiliently deformable lug.

A simple to form yet robust connection may be obtained by a single relatively non-deformable and two resiliently deformable lugs, which are spaced in the peripheral direction of the collar.

Preferably, the dispensing device further comprises at least one stabilizing member arranged in the vicinity of at least one of the lugs. In this way a stable position of the dispensing head on the container is guaranteed. Preferably even a pair of stabilizing members is formed on opposite sides of each lug.

A connection that may easily be formed, yet is sufficiently secure, is obtained when at least the lugs are made of a thermoplastic polyester, especially PET. This plastic material may be processed relatively easily, is sufficiently flexible, is available at reasonable cost, and may very well be recycled. Moreover, PET is transparent and impermeable to gas.

When each recess includes guide faces on at least two side, which slope upwardly in the direction of connection and cooperate with the corresponding lug, the dispensing head may not only be snapped onto the container, but may also be connected thereto by means of a combined pressing and turning movement, forming a bayonet connection. Obviously, the guide surfaces may of course also be arranged on the lugs.

Preferably, each recess includes an upright surface on at least one side thereof which is substantially parallell to the direction of connection, which surface cooperates with the corresponding lug. In this way the lugs are prevented from becoming detached from the recesses by performing a turning movement. The connection is thus strengthened. If so desired the dispensing head or container could include means for disengaging the lug and the upright edge. In this way a childproof connection would be formed, which would still be releasable. The upright surface may obviously be formed on the lugs as well.

In order to allow the dispensing head to be released from the container relatively easily, for instance for refilling the container, the upright surface may slope upwardly against the direction of connection. In this way a sloping guide surface is formed, along which the dispensing head may be screwed loose.

The invention further relates to a method for filling a dispensing device as defined above with a medium to be dispensed. A generally known method of filling comprises the steps of supplying a container, filling the container with the medium to be dispensed through an opening in a wall thereof, and closing off the opening by arranging a dispensing head thereon.

In accordance with the invention a method for filling this specific dispensing device is characterized in that the dispensing head is pressed onto the container and snapped tight. This method of filling may be performed relatively quickly and at low cost, while still achieving an excellent sealing between the container and the dispensing head.

In an alternative method of filling the dispensing head is rotated over a relatively small angle during forcing therof onto the container, so that a bayonet connection is formed.

Figure 2:
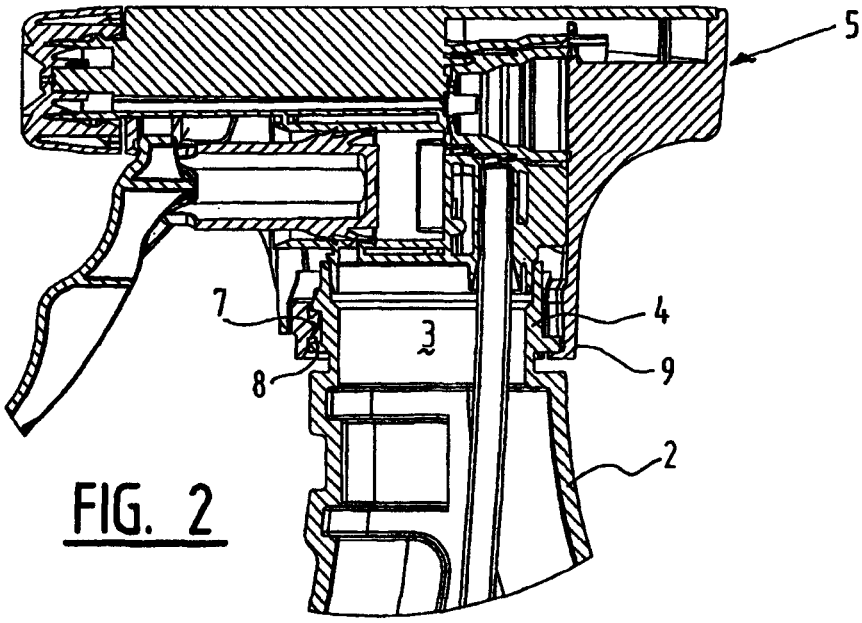
Figure 3:
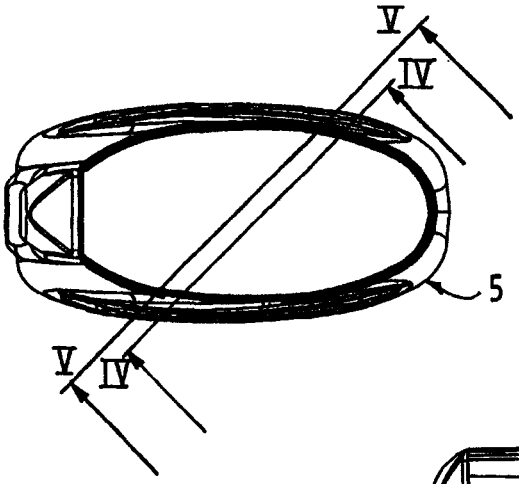
Figure 4:
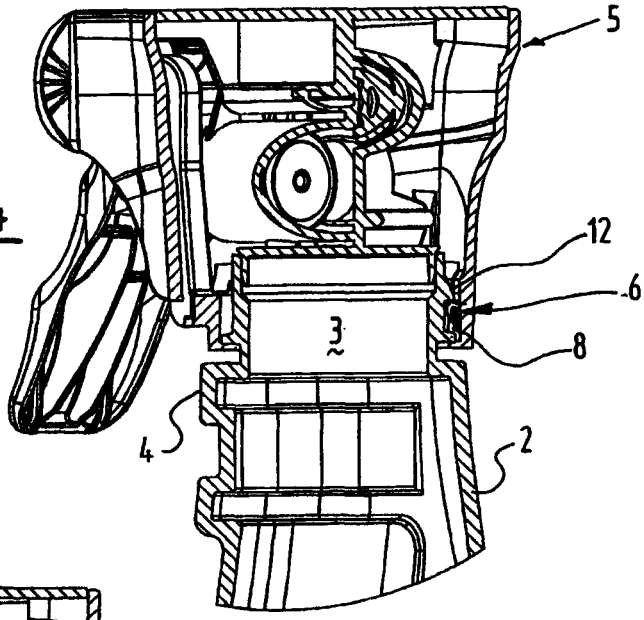
Figure 5:
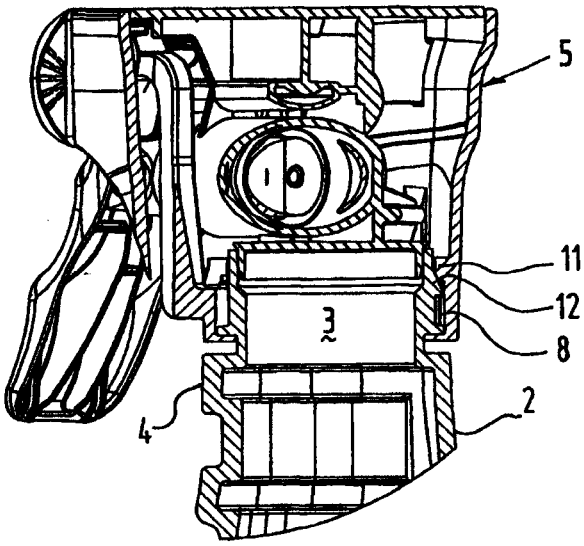
Figure 9:
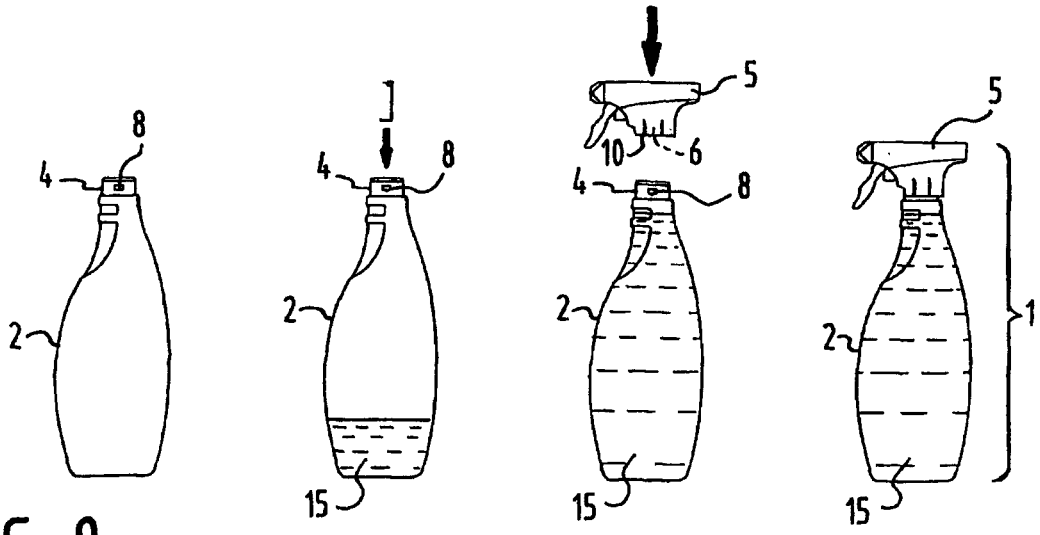
Figure 10:
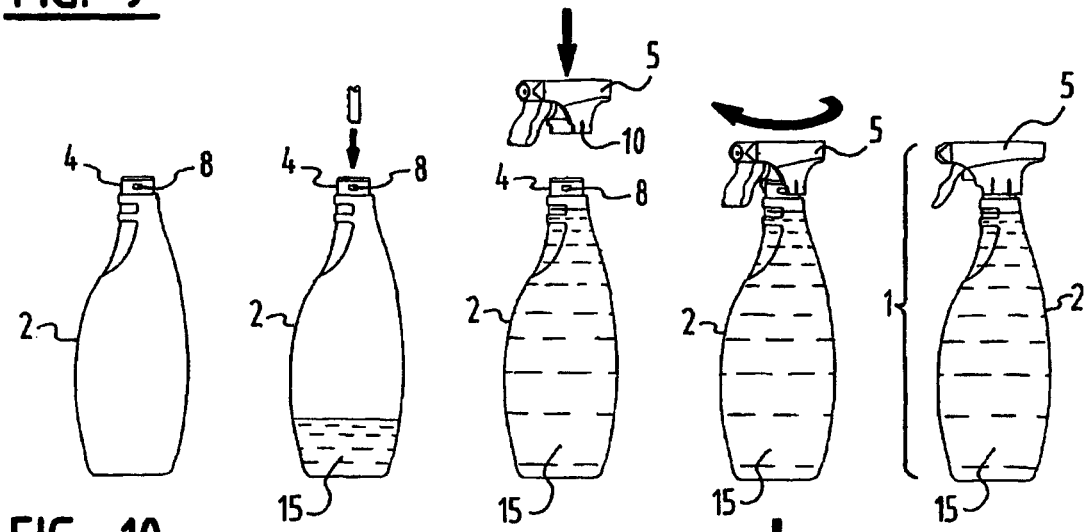
Figure 11:
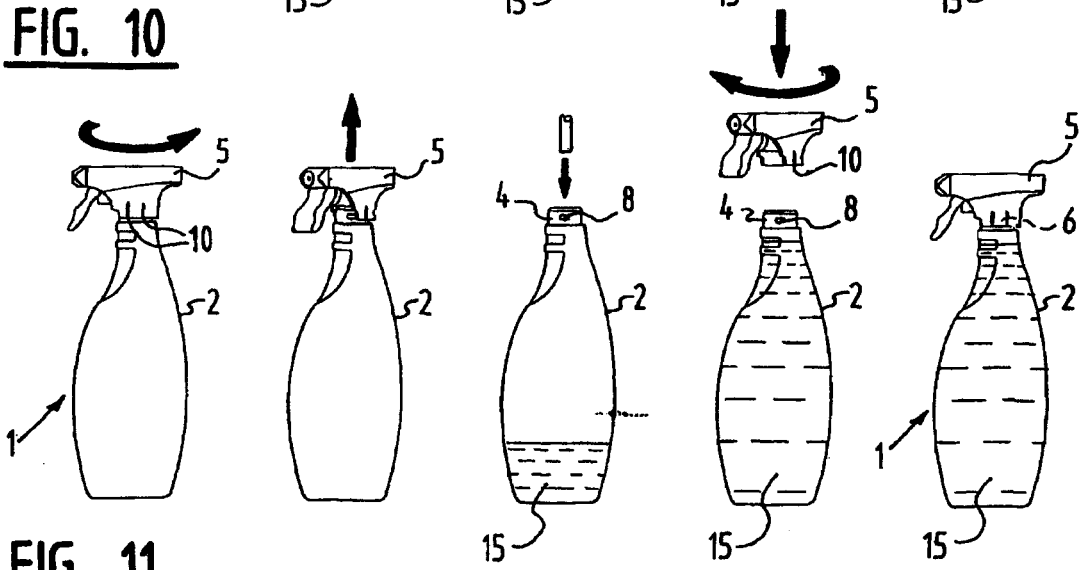

The invention will now be illustrated by way of an embodiment thereof, with reference being made to the annexed drawing, in which:

FIG. 1 is a side view of a dispensing device in accordance with the invention, comprising a container and a dispensing head attached thereon, in assembled state, FIG. 2 is an enlarged scale cross-section of the dispensing head and the upper part of the container of FIG. 1, FIG. 3 is a top view of the dispensing head of FIG. 2, FIG. 4 is a cross-section of the dispensing head and the upper part of the container along the line IV—IV in FIG. 3, FIG. 5 is a cross section of the dispensing head and the upper part of the container along the line V—V in FIG. 3, FIG. 6 is a perspective bottom view of a part of the dispensing head, FIG. 7 is a perspective bottom view of a part of the dispensing head from a different angle, FIG. 8 is a perspective top view of the neck of the container, FIG. 9 schematically shows the various steps of filling the dispensing device, FIG. 10 shows an alternative to the filling method of FIG. 9, and FIG. 11 schematically shows refilling of the dispensing device.

A dispensing device 1 (FIG. 1) consists of a container 2 having a filling and outflow opening 3 at the top. This opening 3 is bordered by a neck 4 on which a dispensing head 5 is attached. For this attachment the container 2 and dispensing head 5 each comprise cooperating snap coupling means, in this case in the shape of a number of lugs 6, 7 and recesses 8 for receiving the lugs. The lugs 6, 7 are arranged at the inside of a collar 9 at the bottom of the dispensing head 5, while the recesses 8 are formed in the outside of the neck 4.

In the shown embodiment three lugs 6, 7 are spaced in peripheral direction, two 6 of which are resiliently flexible, whereas the third lug 7 is relatively stiff and non-deformable. The resiliently flexible character of the lugs 6 is achieved in part by the fact that the collar 9 is locally weakened in the vicinity of these lugs 6 by means of incisions 10.

In order to attach the dispensing head 5 in a stable manner onto the neck 4 of the container 2, pairs of stabilizing members 11 are formed in the vicinity of each of the lugs 6, 7, which in the assembled state of the dispensing device 1 rest on the neck 4.

Around the recesses 8 guide surfaces 12 are formed, which slope upward in the direction of connection, i.e. in the direction in which the dispensing head 5 and the container 2 are attached to each other. In this way the lugs 6, 7 are forced outward when the dispensing head 5 is pressed onto the container 2. The lug 7 will hardly or not at all be deformed, so that the required deformation must be accommodated by the resiliently flexible lugs 6. In this way a very tight connection is formed between the dispensing head 5 and the container 2.

Beside a guide surface 12 at the side facing the dispensing head 5, a guide surface 13 may also be formed along a side of each recess 8 perpendicular thereto. This surface 13 may also slope upward in the direction of connection. In this way the lugs 6, 7 may also be introduced into the recesses 8 from that side when the dispensing head 5 is attached to the container 2 by means of a rotational movement, forming a bayonet connection.

In order to be able to refill the container 2, the dispensing head 5 may be releasably attached thereto. Therefore, in the shown embodiment the recesses are also provided with guide surfaces 14 that slope upwards against the direction of connection.

When it is not desirable for the dispensing head 5 to be released from the container, straight upright surfaces may be formed along the recesses 8, so that the lugs 6, 7 are fixedly held therein.

As an intermediate solution it is conceivable that the side walls of the recesses 8 are formed in such manner that the lugs 6, 7 may only be disengaged from the recesses 8 by means of an additional movement, for instance by partially squeezing the collar 9 and simultaneously rotating it. In that way a childproof connection is accomplished.

The container 2 and dispensing head 5 may in principle be made of any suitable plastic material, specifically any thermoplastic polyester. In the shown embodiment the container 2 and dispensing head 5 are made of PET. This plastic material is very suitable for large-scale manufacturing processes like blow molding and injection molding, is sufficiently strong and flexible, and may be recycled without problem. Moreover, PET is impermeable to gas and transparant, which is an advantage for a great many uses.

Filling and assembling the dispensing device 1 in accordance with the invention is done as follows. The container 2 is supplied empty and is filled with the medium to be dispensed at a filling station (FIG. 9). After that the dispensing head 5 is supplied at a next station and is pressed onto the neck of the container 2. The dispensing head 5 and the container are oriented such, that the lugs 6, 7 and the recesses 8 are exactly aligned. In this way the dispensing head 5 is snapped onto the container.

When the recesses 8 further include guide surfaces 12 along their edges extending in the direction of connection, like in the shown embodiment, the dispensing head 5 may also be attached to the container 2 by means of a combined pressing and turning movement, thus forming a bayonet connection (FIG. 10).

Since the recesses 8 of the shown embodiment also include a guide surface 13 that slopes upward against the direction of connection, the snap or bayonet couplings thus formed may also be released, for instance in order to refill the container 2 (FIG. 11).

Although the invention has been illustrated with reference to an embodiment thereof, it will be clear that it is not limited thereto. For instance more or less than three lugs and recesses could be provided, and the position of the lugs and recesses could also be inverted, with the lugs being arranged on the neck of the container and recessers in the dispensing head. Moreover, the guide surfaces could be formed on the lugs instead of on the edges of the recesses. Consequently, the scope of the invention is defined exclusively by the annexed claims.

The invention claimed is:

1. A dispensing device, comprising a container and a dispensing head connected thereto, said container and head including co-operating snap coupling members comprising a plurality of lugs arranged on one of the two parts to be connected and a plurality of recesses arranged in the other part for receiving the lugs, characterized in that at least one of the lugs is resiliently deformable and at least one other lug is relatively stiff and non-deformable.

2. A dispensing device, comprising a container and a dispensing head connected thereto, said container and head including co-operating snap coupling members comprising a plurality of lugs arranged on one of the two parts to be connected and a plurality of recesses arranged in the other part for receiving the lugs, characterized in that at least one of the lugs is resiliently deformable and at least one other lug is relatively stiff and non-deformable wherein the dispensing head includes a collar directed towards the container and carrying the lugs.

3. A dispensing device as claimed in claim 2, characterized in that the collar includes at least one incision in the vicinity of the or each resiliently deformable lug.

4. A dispensing device as claimed in claim 2 characterized by a single relatively non-deformable and two resiliently deformable lugs, which are spaced in the peripheral direction of the collar.

5. A dispensing device as claimed in claim 1, characterized by at least one stabilizing member arranged in the vicinity of at least one of the lugs.

6. A Dispensing device as claimed in claim 1, in which at least the lugs are made of a plastic material, characterized in that the plastic material is a thermoplastic polyester, especially PET.

7. A Dispensing device as claimed in claim 1, characterized in that each recess includes guide faces on at least two sides, which slope upwardly in the direction of connection and cooperate with the corresponding lug.

8. A Dispensing device as claimed in claim 1, characterized in that each lug includes guide faces on at least two sides, which slope upwardly in the direction of connection and cooperate with the corresponding recess.

9. A Dispensing device as claimed in claim 1, characterized in that each recess includes an upright surface on at least one side thereof which is substantially parallel to the direction of connection, which surface cooperates with the corresponding lug.

10. A Dispensing device as claimed in claim 1, characterized in that each lug includes an upright surface on at least one side thereof which is in substantially parallel with the direction of connection, which surface cooperates with the corresponding recess.

11. A Dispensing device as claimed in claim 9, characterized in that the upright surface slopes upwardly against the direction of connection.

12. A method for filling a dispensing device as claimed in claim 1 with a medium to be dispensed, comprising steps of:

supplying a container, filling the container with the medium to be dispensed through an opening in a wall thereof, and closing off the opening by arranging a dispensing head thereon, characterized in that the dispensing head is pressed and snapped tight onto the container.

13. The method as claimed in claim 12, characterized in that the dispensing head is rotated over a relatively small angle during pressing thereof on the container.

* * * * *

UNITED STATES PATENT AND TRADEMARK OFFICE

CERTIFICATE OF CORRECTION

PATENT NO. : 7,178,702 B2
APPLICATION NO. : 10/432665
DATED : February 20, 2007
INVENTOR(S) : Wilhelmus Johannes Joseph Maas et al.

It is certified that error appears in the above-identified patent and that said Letters Patent is hereby corrected as shown below:

Column 6, Line 15, Claim 12:

Delete "a container" and insert therefor -- the container --.

Column 6, Line 18, Claim 12:

Delete "a dispensing head" and insert -- the dispensing head --.

Signed and Sealed this

Nineteenth Day of June, 2007

JON W. DUDAS
*Director of the United States Patent and Trademark Office*

US007178702C1

(12) INTER PARTES REEXAMINATION CERTIFICATE (0093rd)

United States Patent

Maas et al.

(10) Number: US 7,178,702 C1

(45) Certificate Issued: Aug. 11, 2009

(54) DISPENSING DEVICE AND METHOD FOR FILLING THEREOF

(75) Inventors: Wilhelmus Johannes Joseph Maas, Someren (NL); Petrus Lambertus Wilhelmus Hurkmans, Someren (NL)

(73) Assignee: AFA Polytek B.V., De Helmond (NL)

Reexamination Request:
No. 95/000,273, Jul. 10, 2007

Reexamination Certificate for:

| | |
|---|---|
| Patent No.: | **7,178,702** |
| Issued: | **Feb. 20, 2007** |
| Appl. No.: | **10/432,665** |
| Filed: | **Nov. 10, 2003** |

Certificate of Correction issued Jun. 19, 2007.

(22) PCT Filed: Nov. 27, 2001

(86) PCT No.: PCT/NL01/00861

§ 371 (c)(1),
(2), (4) Date: Nov. 10, 2003

(87) PCT Pub. No.: WO02/42006

PCT Pub. Date: May 30, 2002

(30) Foreign Application Priority Data

Nov. 27, 2000 (NL) ..... 1016714

(51) Int. Cl.

| | |
|---|---|
| ***B67D 5/40*** | (2006.01) |
| ***B65D 39/00*** | (2006.01) |
| ***B65D 41/06*** | (2006.01) |

(52) U.S. Cl. ..... 222/383.1; 215/232; 220/302

(58) Field of Classification Search ..... 222/383.1; 239/333; 220/302; 215/43, 295, 321; 285/360, 285/401

See application file for complete search history.

(56) References Cited

U.S. PATENT DOCUMENTS

| | | | | | |
|---|---|---|---|---|---|
| 1,326,813 | A | * | 12/1919 | Wales | 215/274 |
| 3,462,035 | A | * | 8/1969 | Grussen | 215/253 |
| 5,238,152 | A | | 8/1993 | Maas et al. | |
| 5,845,820 | A | | 12/1998 | Foster | |
| 5,928,594 | A | * | 7/1999 | Foster | 264/255 |

* cited by examiner

*Primary Examiner*—Aaron J. Lewis

(57) ABSTRACT

The invention relates to a dispensing device, comprising a container and a dispensing head connected thereto, the container and head including a co-operating snap coupling means comprising a plurality of lugs arranged on one of the two parts to be connected and a plurality of recesses arranged in the other part for receiving the lugs in which at least one of the lugs is resiliently deformable and at least one other lug is relatively stiff and non-deformable. Such a dispensing device may swiftly and easily be filled and assembled. At least the lugs are advantageously made of a thermoplastic polyester, like e.g. PET. The invention further relates to a method for filling such a dispensing device with a medium to be dispensed.

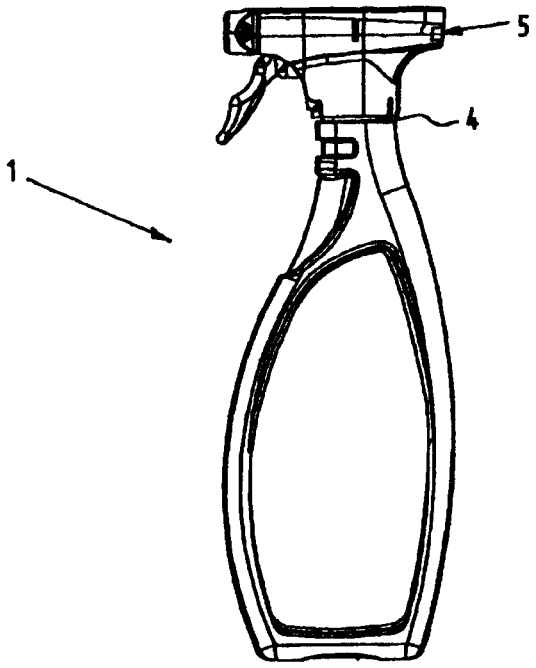

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *